US011490741B1

(12) United States Patent
Pa

(10) Patent No.: US 11,490,741 B1
(45) Date of Patent: Nov. 8, 2022

(54) WATERPROOF BABY CARRIER AND METHODS OF USE

(71) Applicant: Meagan Pa, Woodbridge, VA (US)

(72) Inventor: Meagan Pa, Woodbridge, VA (US)

(73) Assignee: Amphiba Baby LLC, Woodbridge, VA (US)

( * ) Notice: Subject to any disclaimer, the term of this patent is extended or adjusted under 35 U.S.C. 154(b) by 29 days.

(21) Appl. No.: 16/944,283

(22) Filed: Jul. 31, 2020

(51) Int. Cl.
*A47D 13/02* (2006.01)
*A47D 15/00* (2006.01)

(52) U.S. Cl.
CPC ..... *A47D 13/025* (2013.01); *A47D 15/006* (2013.01)

(58) Field of Classification Search
CPC ..... A47D 13/025
See application file for complete search history.

(56) References Cited

U.S. PATENT DOCUMENTS 4,903,873 A 2/1990 Poole et al.
5,848,741 A * 12/1998 Fair ..... A47D 13/025 224/160
6,988,644 B1 * 1/2006 Asherbranner ..... A47D 13/025 224/160
7,255,620 B1 8/2007 Shepherd et al.
7,322,498 B2 * 1/2008 Frost ..... A47D 13/025 224/160
7,770,765 B2 8/2010 Stevens et al.
D693,569 S 11/2013 Lehan
8,590,757 B2 11/2013 Frost
9,022,260 B2 5/2015 Frost
9,144,323 B2 * 9/2015 Lindblom ..... A47D 13/025
9,185,993 B2 11/2015 Telford et al.
9,198,525 B2 12/2015 Wernick et al.
9,220,352 B2 12/2015 Frost
9,277,830 B2 3/2016 Schactner
9,380,887 B2 7/2016 Frost
9,380,888 B2 7/2016 Telford et al.
9,700,152 B2 7/2017 Telford et al.
(Continued)

FOREIGN PATENT DOCUMENTS

AU 201110147 A4 11/2011

OTHER PUBLICATIONS

"Frog Orange Neoprene Baby Carriers" Website, available at https://frogorange.co , last accessed Jul. 30, 2020.
(Continued)

*Primary Examiner* — Derek J Battisti
(74) *Attorney, Agent, or Firm* — Mei & Mark LLP

(57) ABSTRACT

A carrier for holding a baby against the body of a user is provided. The carrier may include a main body, a base layer, a back layer, a child adjustment mechanism, a hood, a shoulder strap, and a hip belt. The main body may have a front side, a back side, a first side edge, a second side edge, a bottom edge, and a top edge. The base layer may be disposed on the front side of the main body. The back layer may be disposed on the back side of the main body. The child adjustment mechanism may be configured to vary and stabilize a carrier seat length. The hood may be attached to the top edge of the main body. The hip belt may be attached to the bottom edge of the main body. The base layer may substantially consist of neoprene. The back layer may substantially consist of a quick-drying, flexible fabric. The carrier may be waterproof.

20 Claims, 14 Drawing Sheets

(56) References Cited

U.S. PATENT DOCUMENTS

| | | | | |
|---|---|---|---|---|
| 9,713,391 | B2 | 7/2017 | Telford et al. | |
| 9,839,302 | B2 | 12/2017 | Frost | |
| 9,955,797 | B2 | 5/2018 | Telford et al. | |
| 10,159,357 | B2 | 12/2018 | Frost | |
| 10,172,478 | B2 | 1/2019 | Telford et al. | |
| 2002/0175194 | A1* | 11/2002 | Norman | A47D 13/025 224/160 |
| 2005/0076856 | A1 | 4/2005 | Bruck et al. | |
| 2006/0102673 | A1* | 5/2006 | Collier | A45C 7/0068 224/581 |
| 2008/0314940 | A1 | 12/2008 | Cohen Raz et al. | |
| 2009/0057360 | A1* | 3/2009 | Demsky | A45F 3/047 224/262 |
| 2010/0107300 | A1* | 5/2010 | Yiu | A41D 1/21 2/85 |
| 2010/0308087 | A1* | 12/2010 | Lindbloom | A47D 13/025 224/160 |
| 2011/0174845 | A1* | 7/2011 | LaBelle | A47D 13/025 224/160 |
| 2011/0186605 | A1* | 8/2011 | Favorito | A47D 13/025 224/160 |
| 2015/0201761 | A1* | 7/2015 | Wollenberg | A45F 4/02 224/576 |
| 2015/0359356 | A1* | 12/2015 | Beekman | A47D 15/00 224/576 |
| 2016/0198865 | A1 | 7/2016 | Houston | |

OTHER PUBLICATIONS

"Free-to-Grow Baby Carrier—Baby Tula US" Website, available at https://babytula.com/collections/free-to-grow-baby-carriers , last accessed Jul. 30, 2020.

* cited by examiner

WATERPROOF BABY CARRIER AND METHODS OF USE

TECHNICAL FIELD

This application relates to baby carriers, as well as methods of using the same. More specifically, this application relates to waterproof baby carriers that hold a baby against the body of the user of the carrier.

BACKGROUND

Baby carriers are used by many parents (and other caregivers) to carry their infants, toddlers, and other young children as they walk, hike, and engage in numerous active and sedentary activities. By using baby carriers, parents are able to monitor and care for their babies, maintain a physical closeness, and engage in other activities—all while keeping their hands free. While some baby carrier substantially consist of a large piece of fabric and/or one or more fasteners, many parents find these more basic carriers to be difficult to use, tedious to put on and take off, and/or unsuitable for larger babies, such as toddlers.

However, existing (non-wrap) baby carriers are both limited in use and costly. Regarding the former, most baby carriers cannot accommodate babies as they grow—e.g., from newborns, to older infants, and to toddlers. Some carriers accommodate a child's growth through the use of one or more inserts, but it can be unwieldy for parents to save, adjust, and/or use the inserts.

Additionally, most baby carriers are designed for dry use only. That is, while they might be able to occasionally get wet, they are not designed for wading in water or swimming. And, after getting wet, such dry-use baby carriers must be carefully dried to avoid mold, mildew, and rot.

A few existing baby carriers are designed to accommodate wading or other water-based activities on a regular basis. However, these carriers are typically made almost entirely of neoprene and, as a result, are heavy, hot, and not conducive to other uses, such as walking or hiking. Moreover, these water-based baby carriers lack sun-protective features for babies and do not accommodate babies at their various stages of growth.

The above-described limitations for existing baby carriers are compounded by their costs. Parents in need of a baby carrier for multiple use cases and at multiple stages of child development are currently forced to purchase multiple baby carriers to meet their needs.

Thus, there exists a need for a baby carrier that may be regularly used for both dry and water-based activities; and is quick drying, relatively light, and adjustable based on a baby's size. It would additionally be advantageous for such a baby carrier to offer sun protection to babies and aid parents in carrying keys and other objects.

SUMMARY

The present disclosure provides a description of apparatuses and systems to address the perceived problems described above, as well as methods for using the same.

In one embodiment, a carrier for holding a baby against the body of a user is provided. The carrier may include a main body, a base layer of the main body, a back layer of the main body, a child adjustment mechanism of the main body, a hood, at least one shoulder strap, and a hip belt. The main body may have a front side, a back side, a first side edge, a second side edge, a bottom edge, and a top edge. The base layer may be disposed on the front side of the main body. The back layer may be disposed on the back side of the main body. The child adjustment mechanism may be configured to vary and stabilize a carrier seat length. The hood may be attached to the top edge of the main body. The hip belt may be attached to the bottom edge of the main body. The base layer may substantially consist of neoprene. The back layer may substantially consist of a quick-drying, flexible fabric. The carrier may be waterproof.

The hood may substantially consist of the quick-drying, flexible fabric.

The hood may include an inner hood layer, an outer hood layer, a hem, and a hood strap. The hem may contain an elastic band. The inner hood layer and the outer hood layer may substantially consist of the quick-drying, flexible fabric.

The quick-drying, flexible fabric may substantially consist of Nylon and Spandex. The quick-drying, flexible fabric may be a nylon-spandex mesh with anti-microbial properties. The quick-drying, flexible fabric may consist of 85%-95% Nylon and 5-15% Spandex.

At least one of the inner hood layer and outer hood layer may integrally formed with the back layer.

The base layer may be 3 mm neoprene.

The main body may include at least one pocket disposed on the front side of the main body. A portion of the base layer may serve as a back side of the at least one pocket.

The at least one pocket may include a zipper pocket. The zipper pocket may include a zipper and a pocket layer. The pocket layer may be secured to the base layer. A first side of the zipper may be secured to the base layer. A second side of the zipper may be secured to the pocket layer. The pocket layer may substantially consist of neoprene.

The at least one pocket may include a first stretch pocket. The first stretch pocket may include a stretch pocket layer and a first pocket hem. The first stretch pocket layer may be secured to the base layer. The first pocket hem may contain an elastic band. The edges of the hem may be secured to the base layer. The stretch pocket layer may substantially consist of Lycra.

The at least one pocket may further include a secondary stretch pocket. The secondary stretch pocket may be disposed between the stretch pocket layer and the base layer. The secondary stretch pocket may include a secondary stretch pocket fabric and a second pocket hem. The second pocket hem may be secured to the base layer and the stretch pocket layer. The second pocket hem may contain a second elastic band. The secondary stretch pocket fabric may substantially consist of Lycra or a Nylon-spandex mesh.

The at least one pocket may include a zipper pocket and a first stretch pocket. The zipper pocket may include a zipper and a pocket layer. The pocket layer may be secured to the base layer. The first side of the zipper may be secured to the base layer. A second side of the zipper may be secured to the pocket layer. The pocket layer may substantially consist of neoprene. The first stretch pocket may include a stretch pocket layer and a first pocket hem. The first stretch pocket layer may secured to the base layer. The first pocket hem may contain an elastic band. Edges of the hem may be secured to the base layer. The stretch pocket layer may substantially consist of Lycra.

A first non-zippered edge of the pocket layer and a first non-hemmed edge of the first stretch pocket layer may abut along a central seam of the front of the main body. A second non-zippered edge of the pocket layer abut a top of the child adjustment mechanism. A second non-hemmed edge of the first stretch pocket layer may abut the top of the child adjustment mechanism. The front of the main body further may further include a key loop. The key loop may being secured to the base layer by the central seam.

The child adjustment mechanism may include a drawstring, an enclosure layer, a cinch mechanism, and a portion of the base layer. The drawstring may include a first drawstring side and a second drawstring side. The enclosure layer and the portion of the base layer may be securely attached on all edges of the enclosure layer to form an enclosure. The first drawstring side and the second drawstring side may be partially enclosed within the enclosure. The enclosure layer may include a first drawstring hole and a second drawstring hole. An end of the first drawstring side may be secured to a first point on the base layer. The first drawstring side may extend through the first drawstring hole. An end of the second drawstring side may be secured to a second point on the base layer. The second drawstring side may extend through the second drawstring hole. The cinch mechanism may be configured to vary and stabilize the carrier seat length by securing an external portion of the first drawstring side to an external portion of the second drawstring side.

The first point on the base layer may be along the first side edge of the main body. The second point on the base layer may be along the second side edge of the main body. The enclosure layer may substantially consist of neoprene.

The child adjustment mechanism may configured to vary and stabilize the carrier seat length to accommodate the baby when the baby is at least as small as 10 lb. The child adjustment mechanism may be configured to vary and stabilize the carrier seat length to accommodate the baby when the baby is at least as large as 40 lb.

The main body may further include a first angled attachment edge disposed between the top edge of the main body and the first side edge of the main body and a second angled attachment edge disposed between the top edge of the main body and the second side edge of the main body. The at least one shoulder strap may further include a first shoulder strap and a second should strap. The first shoulder strap may be securely attached to the first angled attachment edge of the main body and at the bottom edge of the main body. The second shoulder strap may be securely attached to the second angled attachment edge of the main body and at the bottom edge of the main body.

A substantial portion of the at least one shoulder strap may be partially enclosed between the base layer and the back layer. An upper portion of the at least one shoulder strap may comprise neoprene.

The hip belt may include an inner belt layer, an outer belt layer, and a hip strap. The inner belt layer and the outer belt layer may substantially consist of neoprene. The hip strap may secured to the outer belt layer and may substantially consist of nylon webbing.

BRIEF DESCRIPTION OF THE DRAWINGS

The accompanying drawings, which are incorporated into and constitute a part of this specification, illustrate several embodiments and aspects of the apparatuses and methods described herein and, together with the description, serve to explain the principles of the invention.

DETAILED DESCRIPTION

Figure 1A:
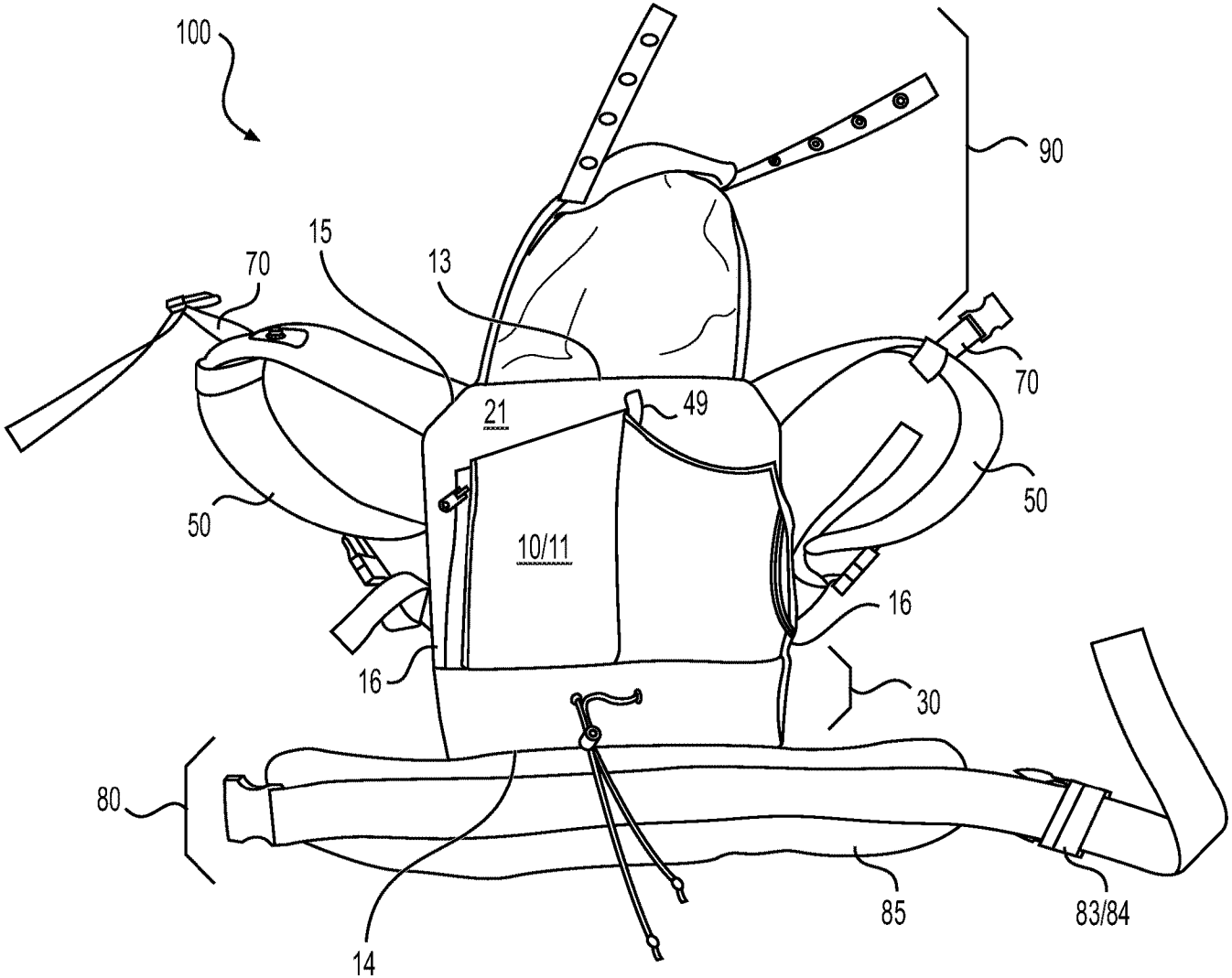
FIGS. 1A and 1C depict the front of an embodiment of a baby carrier in an open configuration, consistent with the present disclosure.
Figure 1B:
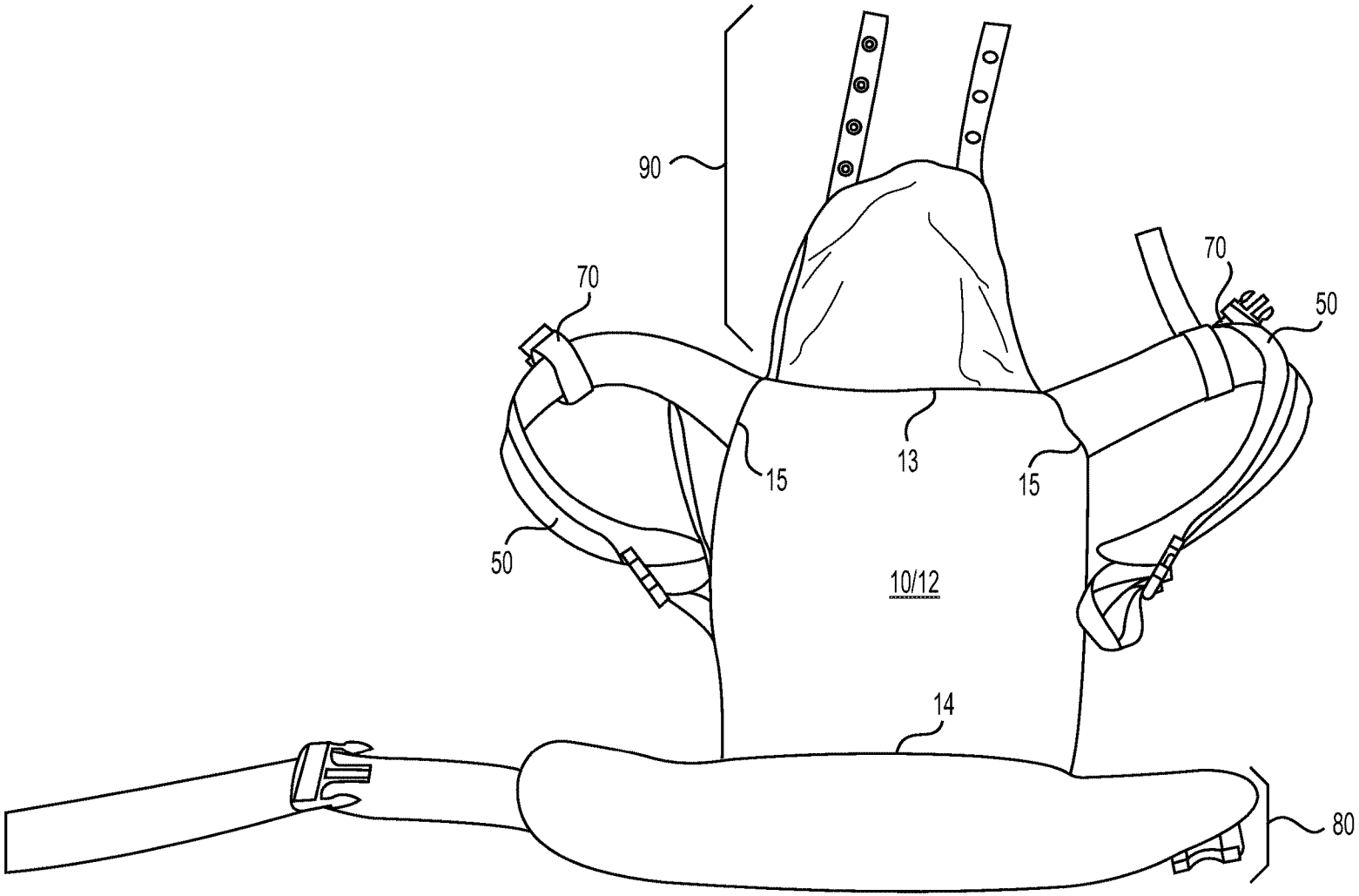
FIGS. 1B and 1D depict the back of the embodiment of FIGS. 1A and 1C in an open configuration, consistent with the present disclosure.

With reference to FIGS. 1A and 1B, baby carrier 100 may include hip belt 80, main body 10, hood 90, shoulder straps 50, and back strap 70. In various preferred embodiments, baby carrier 1 may safely and securely carry baby 2 of between 7 lb and 50 lb., more narrowly between 7 lb. to 40 lb. or 10 lb. to 40 lb, and even more narrowly between 10 lb. and 40 lb. As used herein, "baby," but may include newborns, other infants, toddlers, and other small children.

It is further contemplated that certain pets in and around the above-listed weight ranges may be carried in embodiments of baby carrier 100. For example, certain baby carrier 100 embodiments may accommodate certain small or medium-sized dogs.

FIGS. 2A-2E depict, from various angles, baby carrier 100 holding a larger baby 2 and being worn by user 1 on the on the front of user 1 without using hood 90. As may be observed, in this configuration, baby 2 faces user 1, and hood 90 hangs down. FIG. 2F depicts baby carrier 100 holding a smaller baby 2 and being worn by user 1 on the front of user 1 without using hood 90.

Figure 3A:
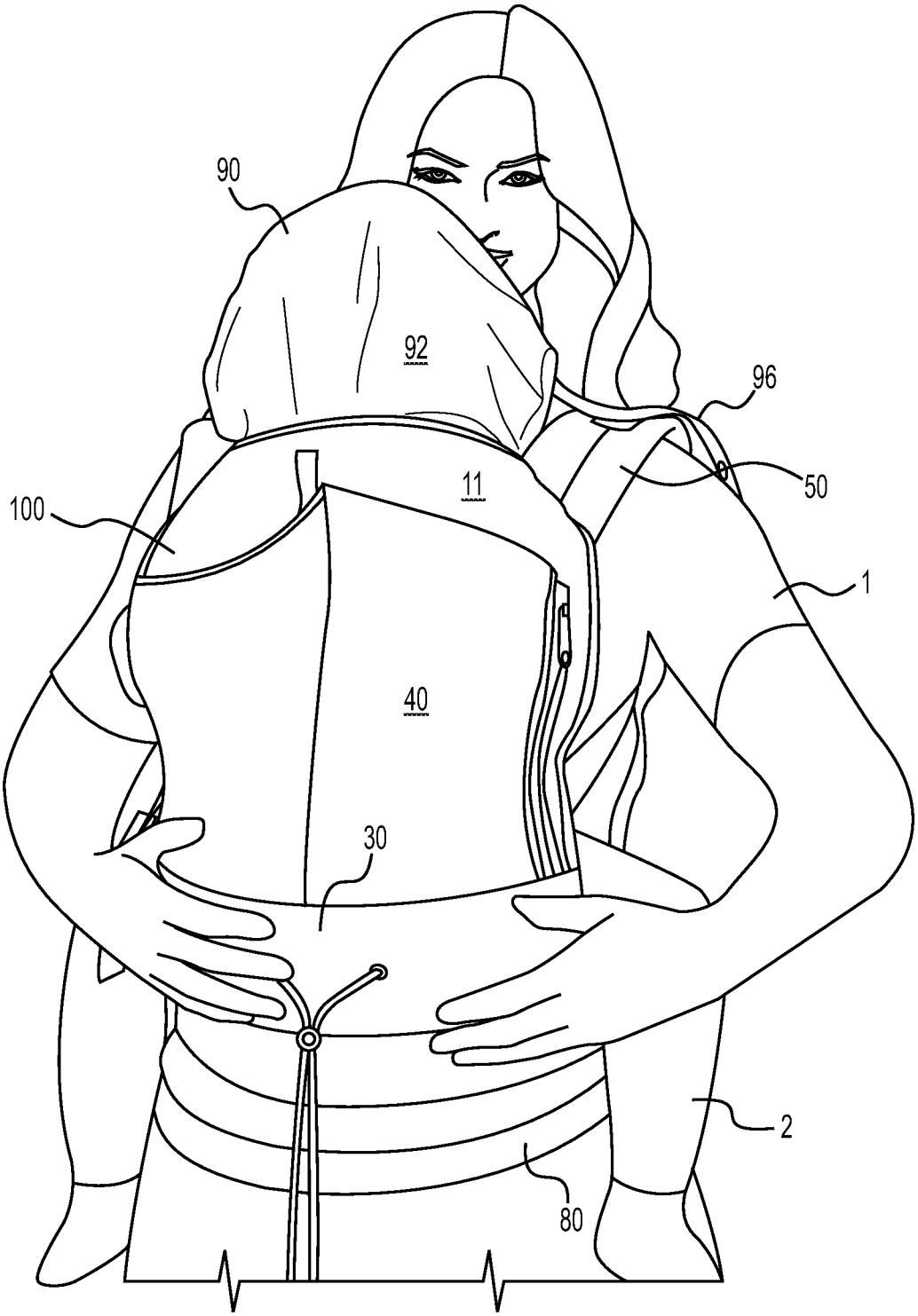
FIGS. 3A and 3B depict an embodiment of a baby carrier in a second use configuration from the perspective front and back, respectively, consistent with the present disclosure.
Figure 3B:
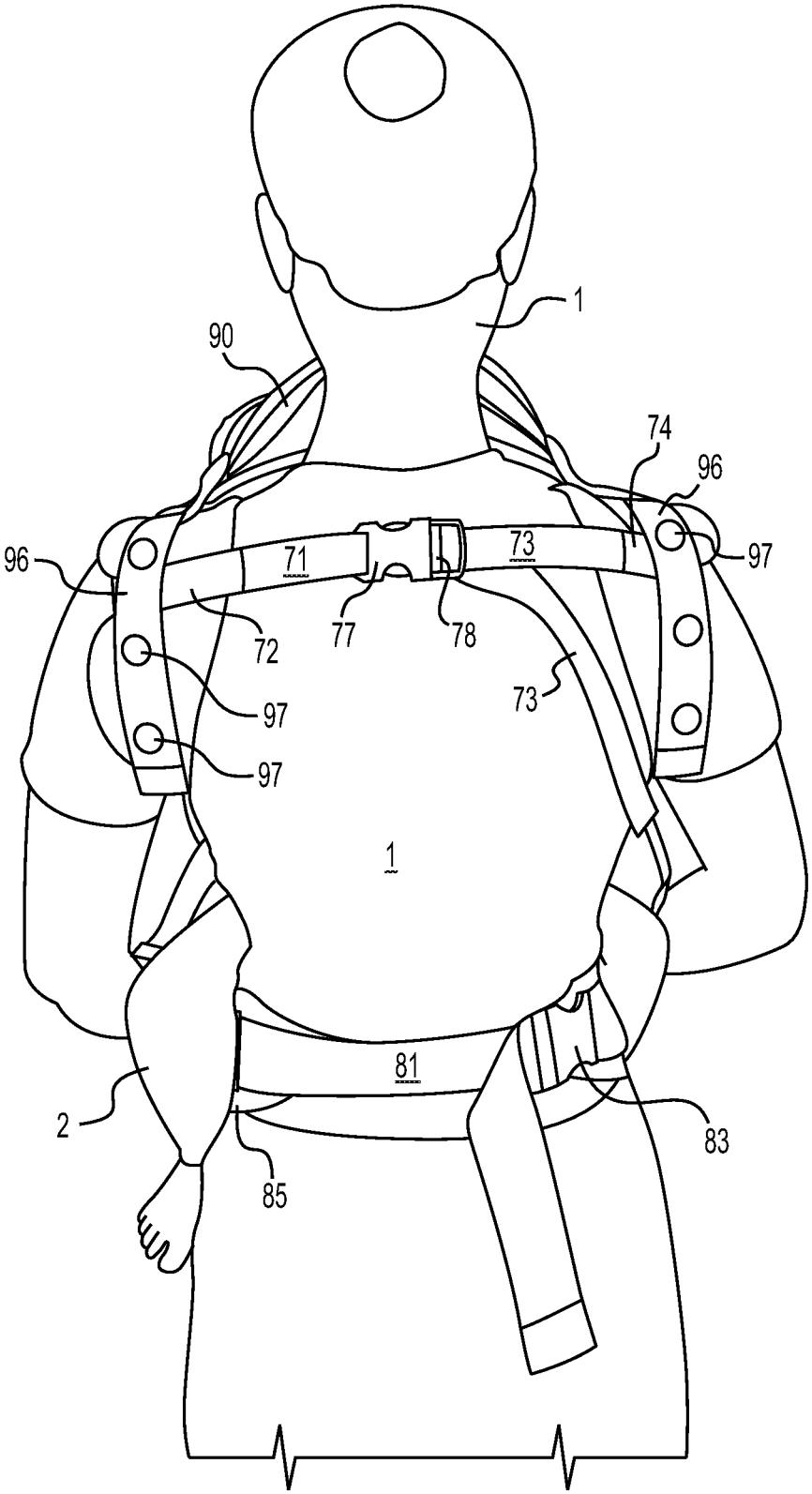

FIGS. 3A and 3B depict, from the perspective front and back angles, respectively, baby carrier 100 holding a larger baby 2 and being worn by user 1 on the front of user 1 and with the hood in use.

Figure 4:
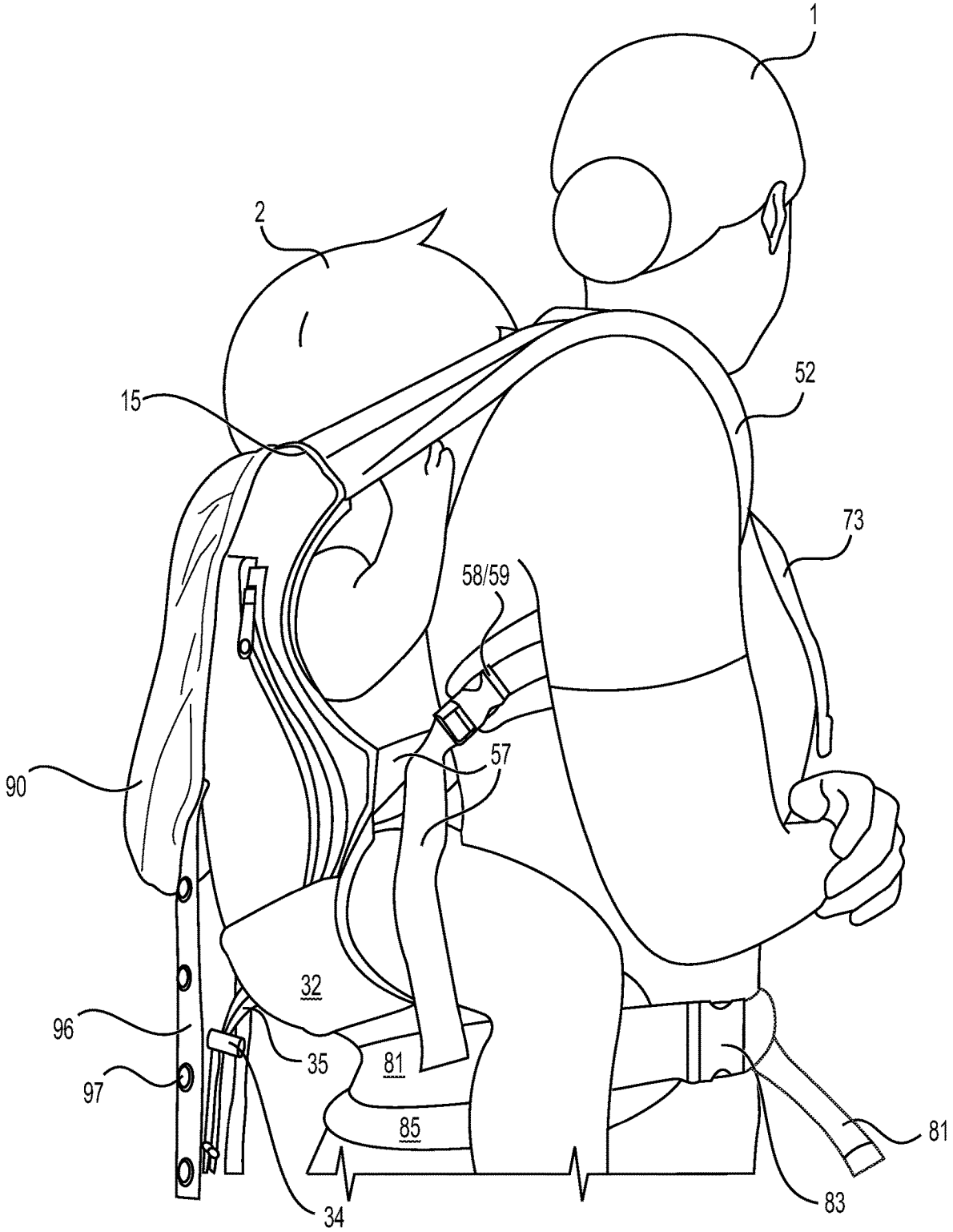
FIG. 4 depicts an embodiment of a baby carrier in a third use configuration from the right, consistent with the present disclosure.

FIG. 4 depicts baby carrier 100 holding a larger baby 2 and being worn by user 1 on the back of user 1 without using hood 90. As would be appreciated by one of ordinary skill in the art, preferred embodiments of baby carrier 100 are reversible and accordingly may be worn on the front or the back of the user. Hood 90 may also be optionally used when baby carrier 100 is worn on the back of user 1.

Additionally, although, as shown in FIGS. 2A-4, baby 2 may preferably face user 1 when held in baby carrier 100, it is contemplated that certain babies 2, especially larger babies, may be held in baby carrier 100 while facing away from user 1.

With reference to FIGS. 1A and 1B, main body 10 may be defined by a front side 11 (as shown in FIG. 1A), a back side 12 (as shown in FIG. 1B), top edge 13, side edges 16, bottom edge 14, and angled attachment edges 15. Main body 50 may be securely attached to hip belt 80 at bottom edge 14; to the upper portion of each shoulder strap 50 at angled attachment edge 15; to the lower portion of each shoulder strap 50 at bottom edge 14; and to hood 90 at top edge 13. Each side of back strap 70 may be configured to loosely attached to a shoulder strap 50. Front side 11 may include a base layer 21, pockets 40, key loop 49, and/or child adjustment mechanism 30. Back side 12 may include back layer 25. Base layer 21 and back layer 25 may be sewn together or otherwise connected along top edge 13, side edges 16, bottom edge 14, and angled attachment edges 15

In certain embodiments base layer 21 be comprised of neoprene, for example, 3 mm neoprene. In alternative embodiments, different thicknesses of neoprene, for example between 1 mm and 5 mm may be used. However, it should be noted that use of thinner layers of neoprene, for example, at or below 2.5 mm, 2 mm, or 1.5 mm, for base layer 21 may result in a baby carrier 100 with weaker structural integrity or durability. Such alternative embodiments may be lighter, but may not be sufficiently strong to carry a larger baby 1. It should also be noted that use of thicker layers of neoprene, for example, at or above 3.5 mm, 4 mm, or 4.5 mm, for base layer 21 may result in a baby carrier 100 that is undesirably heavy and/or retains too much heat. Such alternative embodiments may have extra structural robustness and durability, but may be too heavy for some users 1 and their use may tend to cause user 1 or baby 2 to overheat, especially in warmer climates, on hot days, and for dry uses.

Neoprene may be a preferred material for base layer 21 and other element of baby carrier 100 disclosed herein because it is a material that is waterproof, durable, generally nonporous, flexible, and soft. Neoprene's nonporous characteristics enable it to dry quickly and thereby avoid mildew, mold, or other rot. Neoprene's flexibility promotes comfort and fit for both user 1 and baby 2 while baby carrier 100 maintains a secure hold of baby 1. And, the softness and/or other characteristics of neoprene's surface reduce the likelihood of chafing and/or other irritation on the skin of user 1 and baby 2. Alternative suitable natural and/or synthetic materials known in the art are also contemplated for base layer 21.

In certain embodiments, back layer 25 may be a stretch mesh or wicking fabric, and in some preferred embodiments back layer 25 may have anti-microbial properties. Preferably, back layer 25 may be thin, light, flexible, soft, quick-drying, and durable. For example, in some preferred embodiments, back layer 25 may predominantly comprise nylon and spandex, such as at approximately, 85%-95% Nylon and 5-15% Spandex. For example, a blend of 91% Nylon and 9% Spandex may be used. Other embodiments may include these materials in various other proportions, and/or in combination with other natural and/or synthetic fibers, such as, but not limited to, cotton and polyester.

Figure 1C:
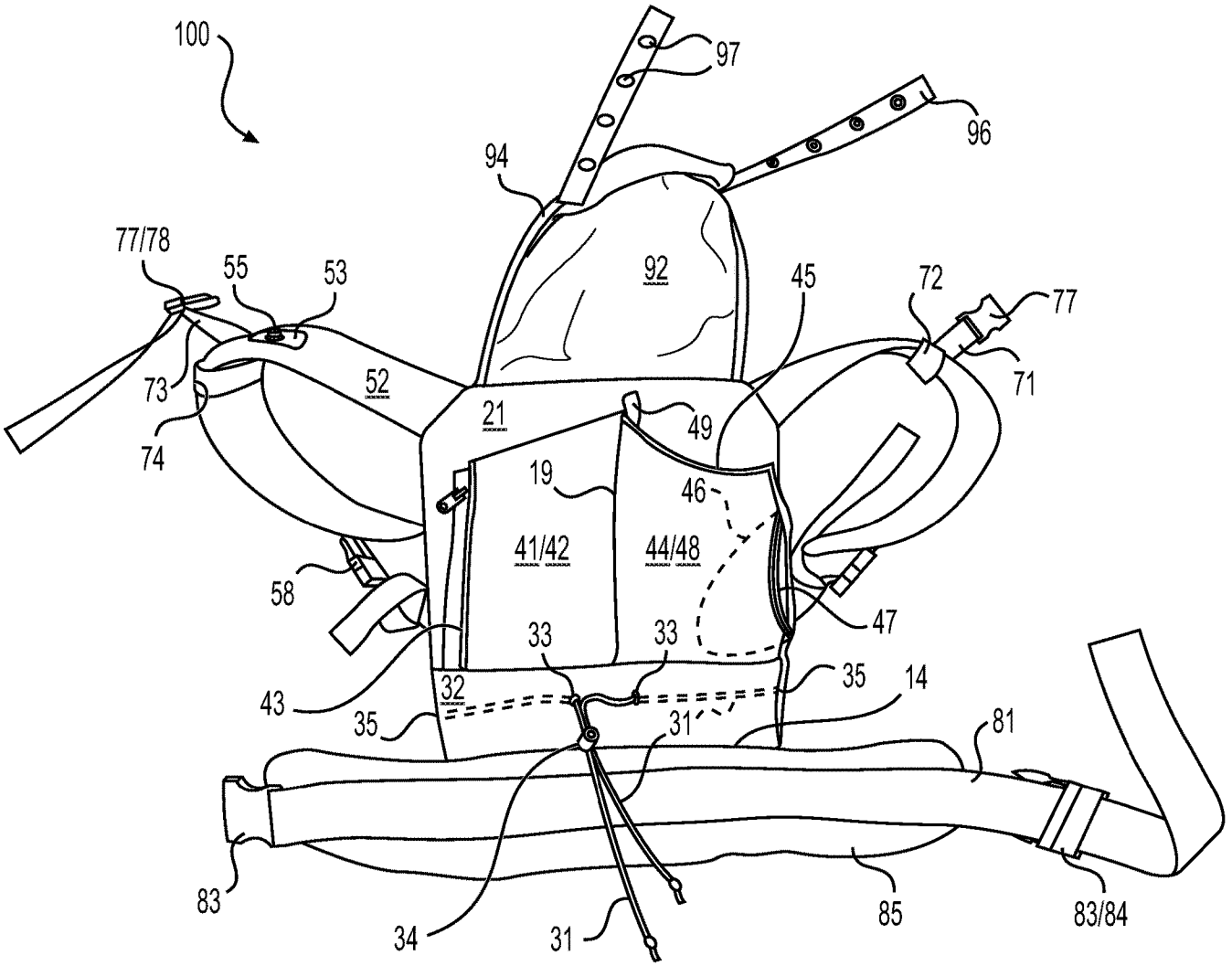
Figure 1D:
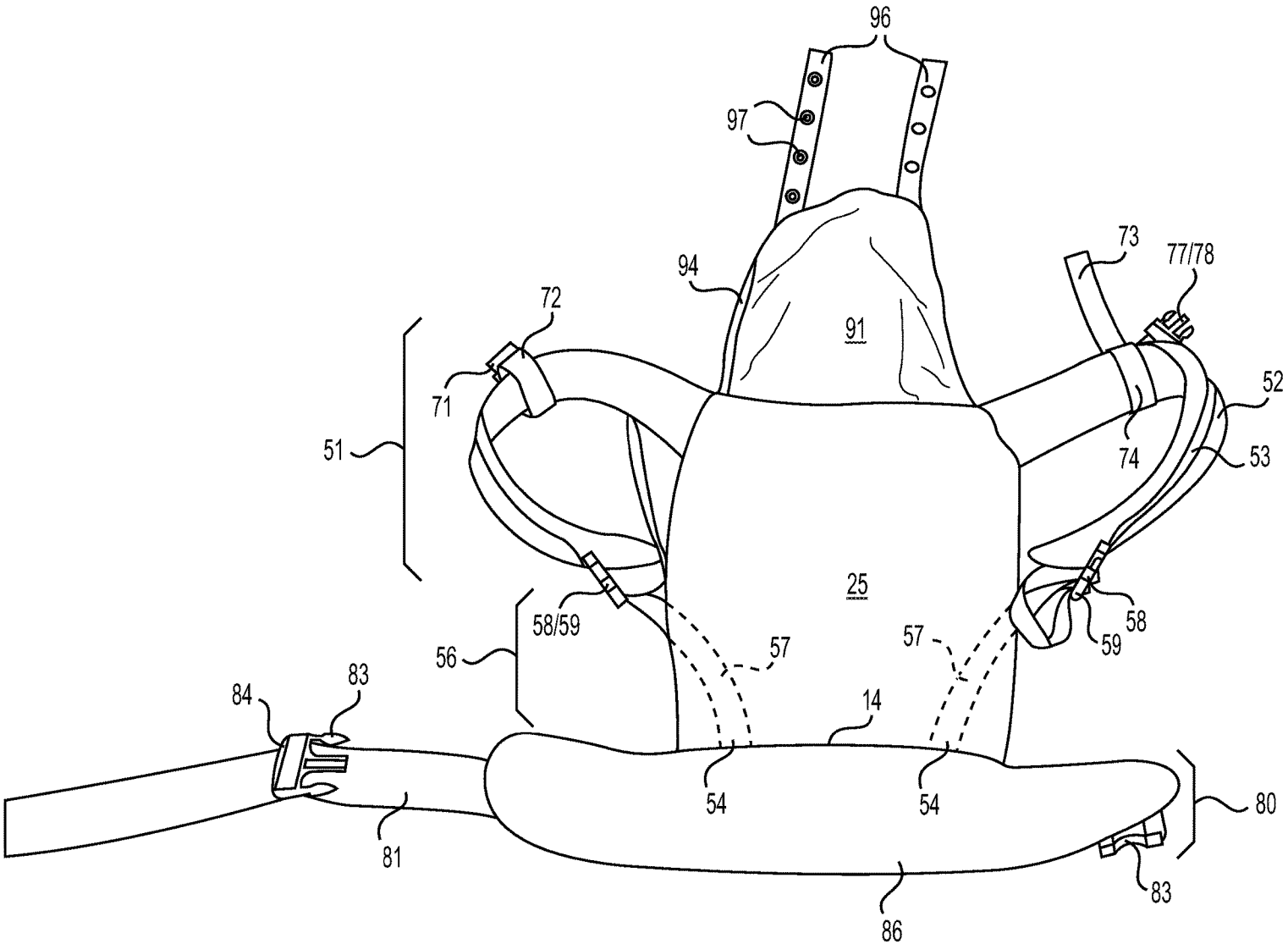
Figure 1E:
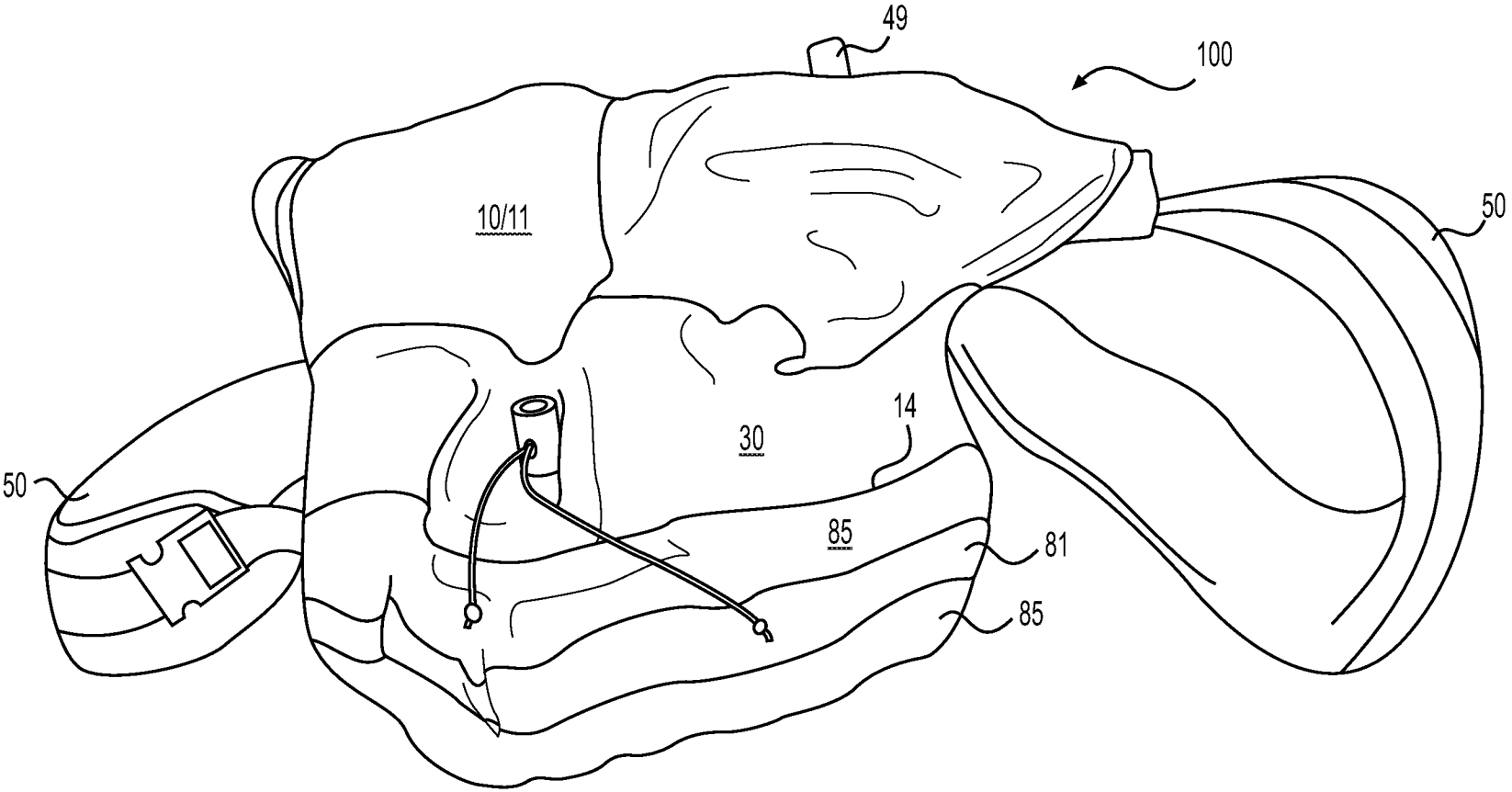
FIG. 1E depicts a portion of the front of the embodiment of FIGS. 1A-1D in an open configuration, wherein the baby carrier is adjusted to fit an infant, consistent with the present disclosure.

With reference to FIGS. 1A, 1C, and 1E, child adjustment mechanism 30 may comprise drawstring 31, child adjustment enclosure layer 32, drawstring holes 33, and drawstring cinch 34. Child adjustment mechanism 30 may also be understood to comprise a portion of base layer 21. In preferred embodiments, child adjustment enclosure layer 32 may comprise the same material as base layer 21, such as 3 mm neoprene. In preferred embodiments the portion of base layer 21 that comprises part of child adjustment mechanism 30 is integrally formed with other portions of base layer 21, but this disclosure is not so limited; in alternative embodiments, the portion of base layer 21 that comprises part of child adjustment mechanism 30 may be a distinct piece of fabric from other portions of base layer 21 and/or may comprise a different material.

As may best be observed in FIG. 1C, child adjustment enclosure layer 32 may be securely attached to base layer 21 along its edges, by for example, sewing with nylon thread, sewing with another material, gluing, and/or another method known in the art. For example, child adjustment enclosure layer 32 and base layer 21 may be securely attached along bottom edge 14, a portion of side edge 16, and along the top of child adjustment enclosure layer 32. Accordingly, an enclosure may be formed between child adjustment enclosure layer 32 and the portion of base layer 21. Each side of drawstring 31 may be secured to base layer 21 and/or child adjustment enclosure layer 32 at draw string attachment points 35. In preferred embodiments, each drawstring attachment point 35 may comprise a portion of side edge 16 wherein child adjustment enclosure layer 32 and base layer 21 are securely attached together.

Each side of drawstring 31 may be partially enclosed within a enclosure formed by child adjustment enclosure layer 32 and base layer 21 and may extend through child adjustment enclosure layer 32 via one of two drawstring holes 33 in child adjustment enclosure layer 32. Outside of the enclosure, each side of drawstring 31 may be connected together by drawstring cinch mechanism 34.

With reference to FIGS. 1E and 2F, to accommodate a smaller baby 2, drawstring cinch mechanism 34 may abut the outside of child adjustment enclosure layer 32 and secure both sides of drawstring 31 together. In this manner, draw string attachment points 35 may be pulled closer together, shrinking the seat area available for baby 2 to less than its maximum, relaxed size. It is contemplated that, when in use, baby 2 may sit above and indirectly sit on drawstring 31. The size of the area available for baby 2 to sit may be variable based on how much of drawstring 31 is pulled through drawstring holes 33 and secured by drawstring cinch 34. The linear distance between attachment points 35 may be defined as the carrier seat length; it is the length of the seat where baby 2 may sit.

Figure 2A:
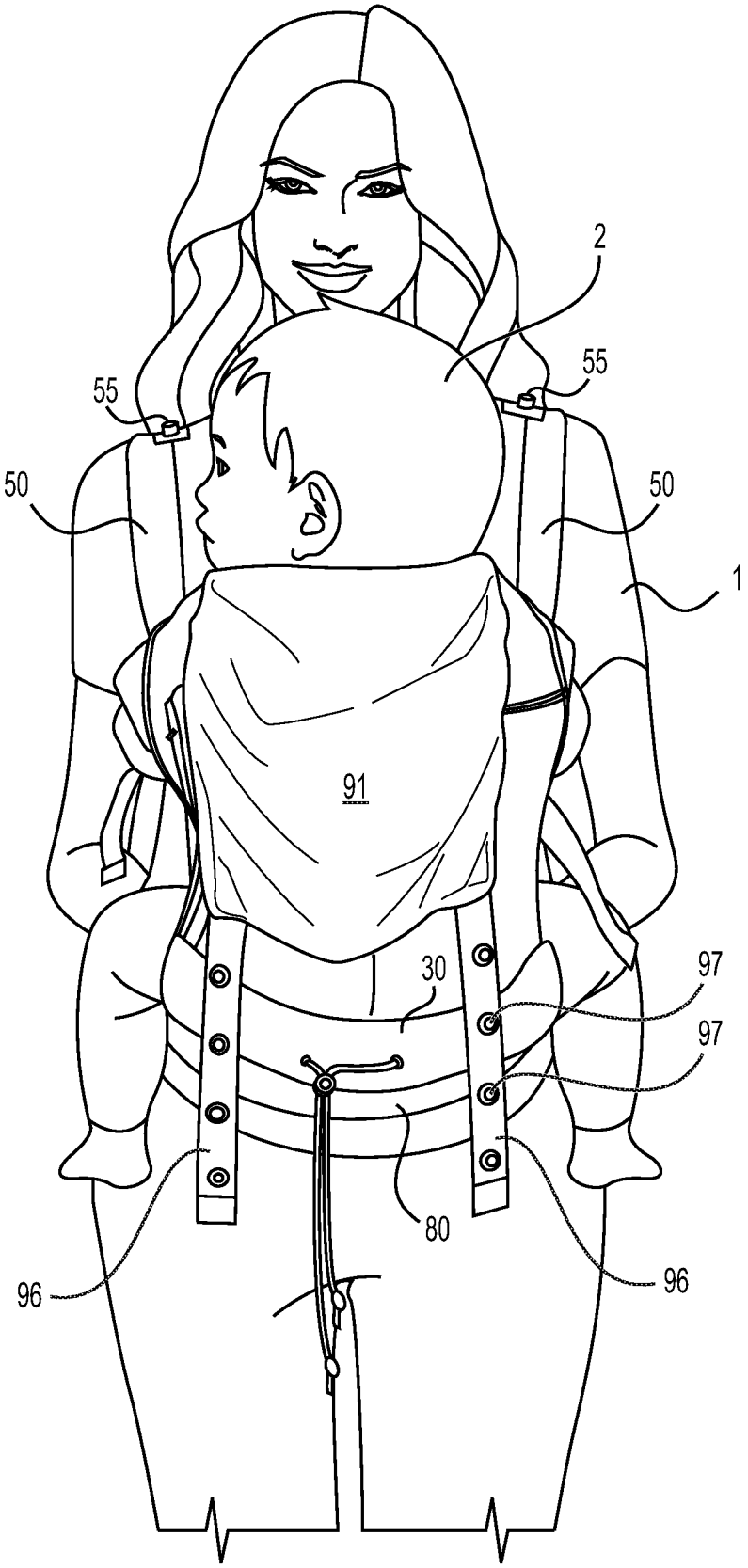
FIGS. 2A-2F depict an embodiment of a baby carrier in a first use configuration from the front, back, top, bottom, left, and right, respectively, consistent with the present disclosure.
Figure 2B:
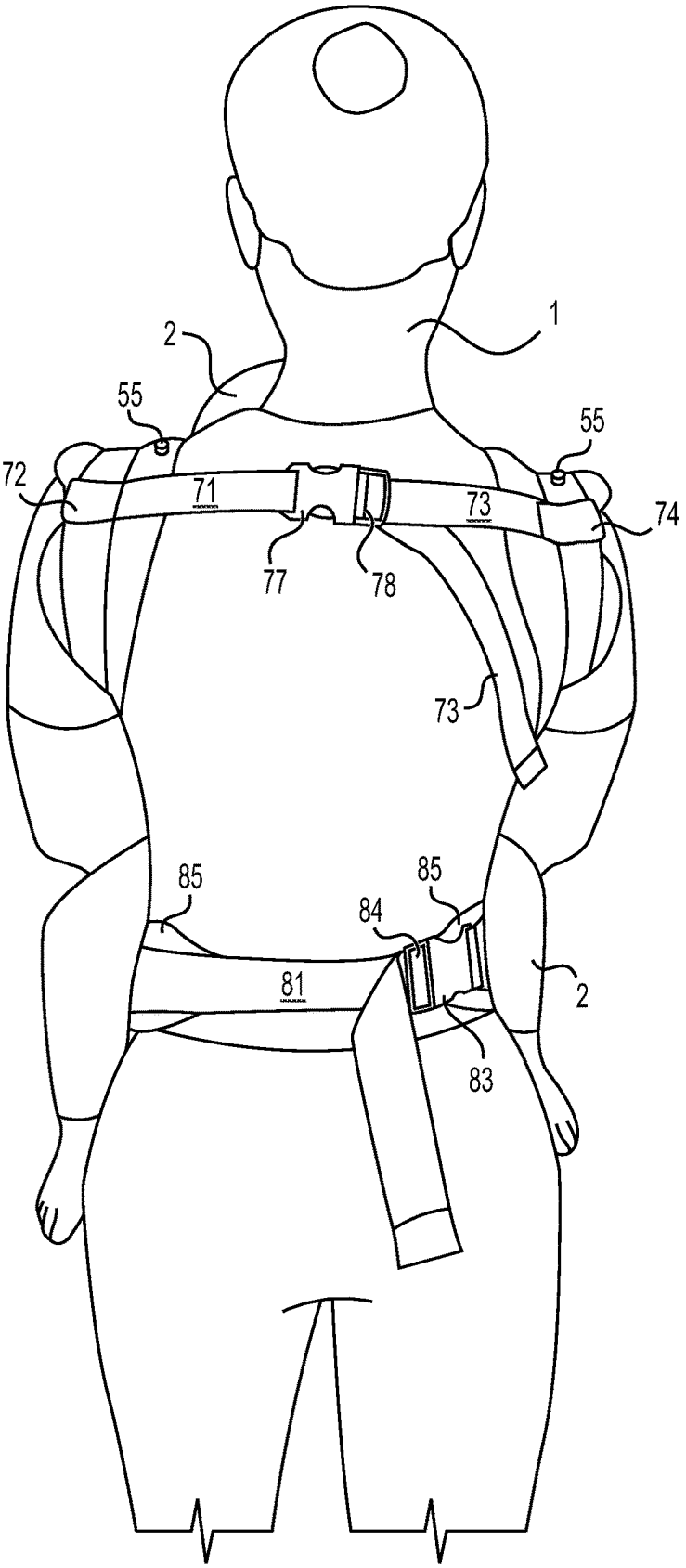
Figure 2C:
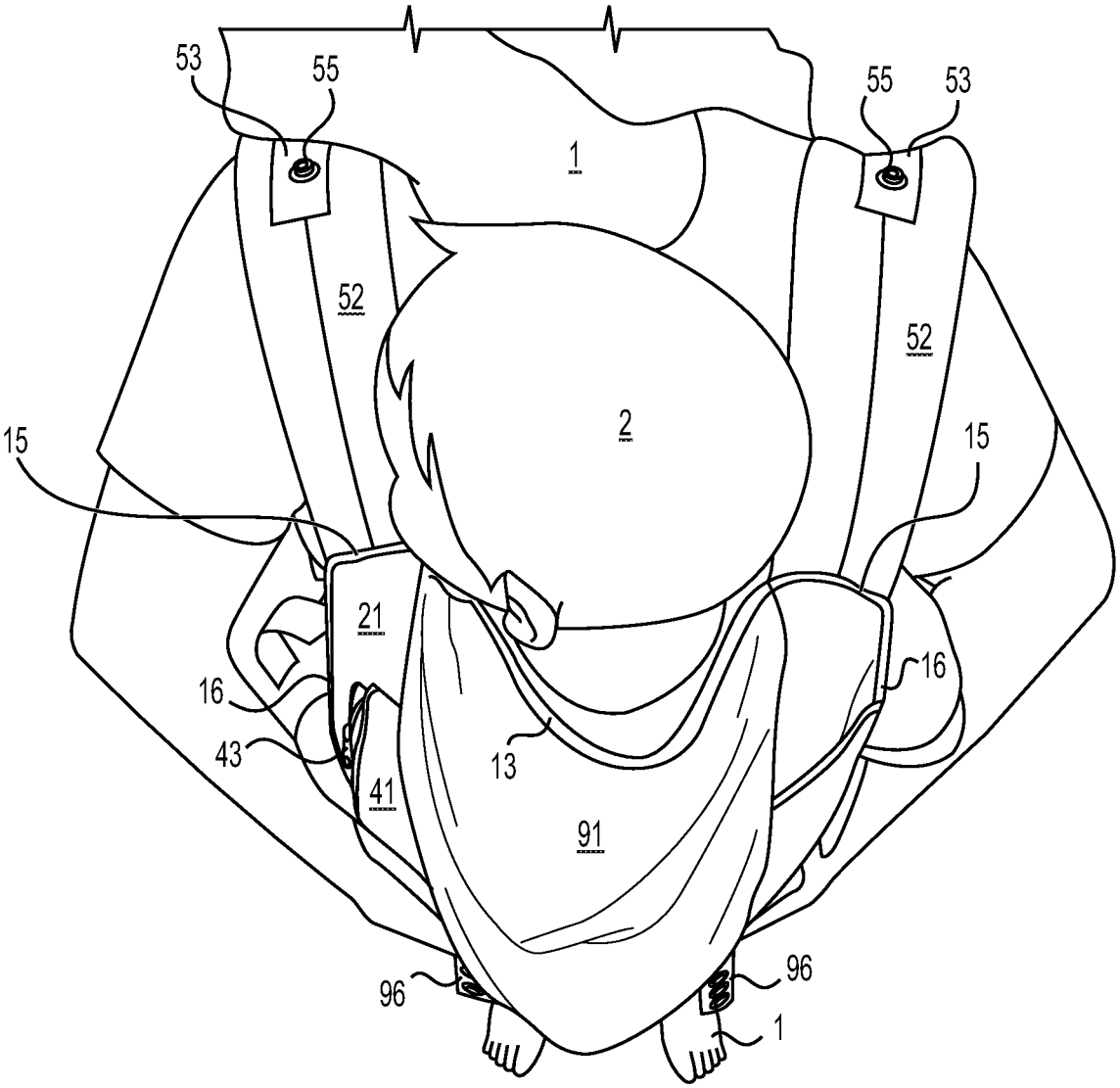
Figure 2D:
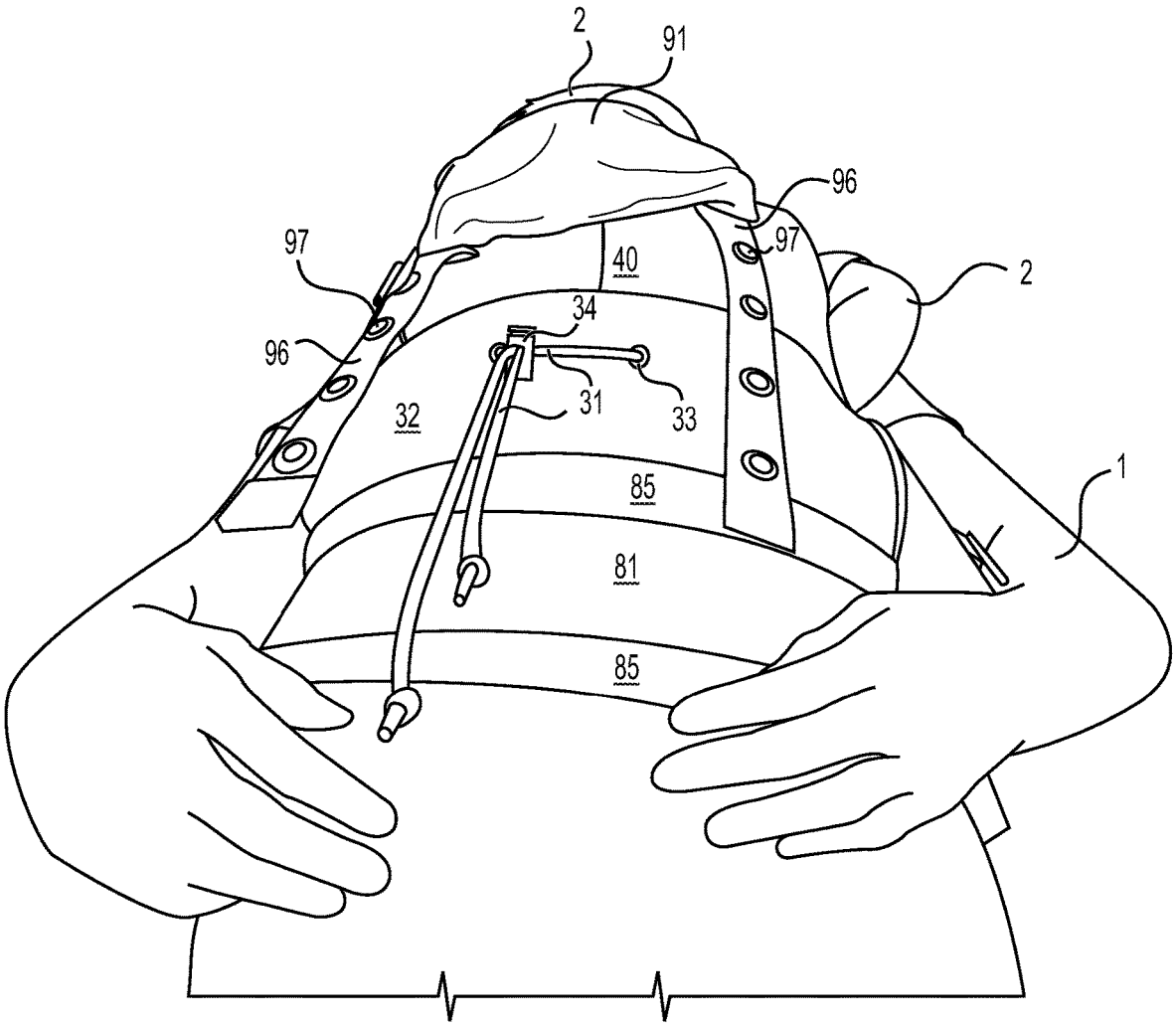
Figure 2E:
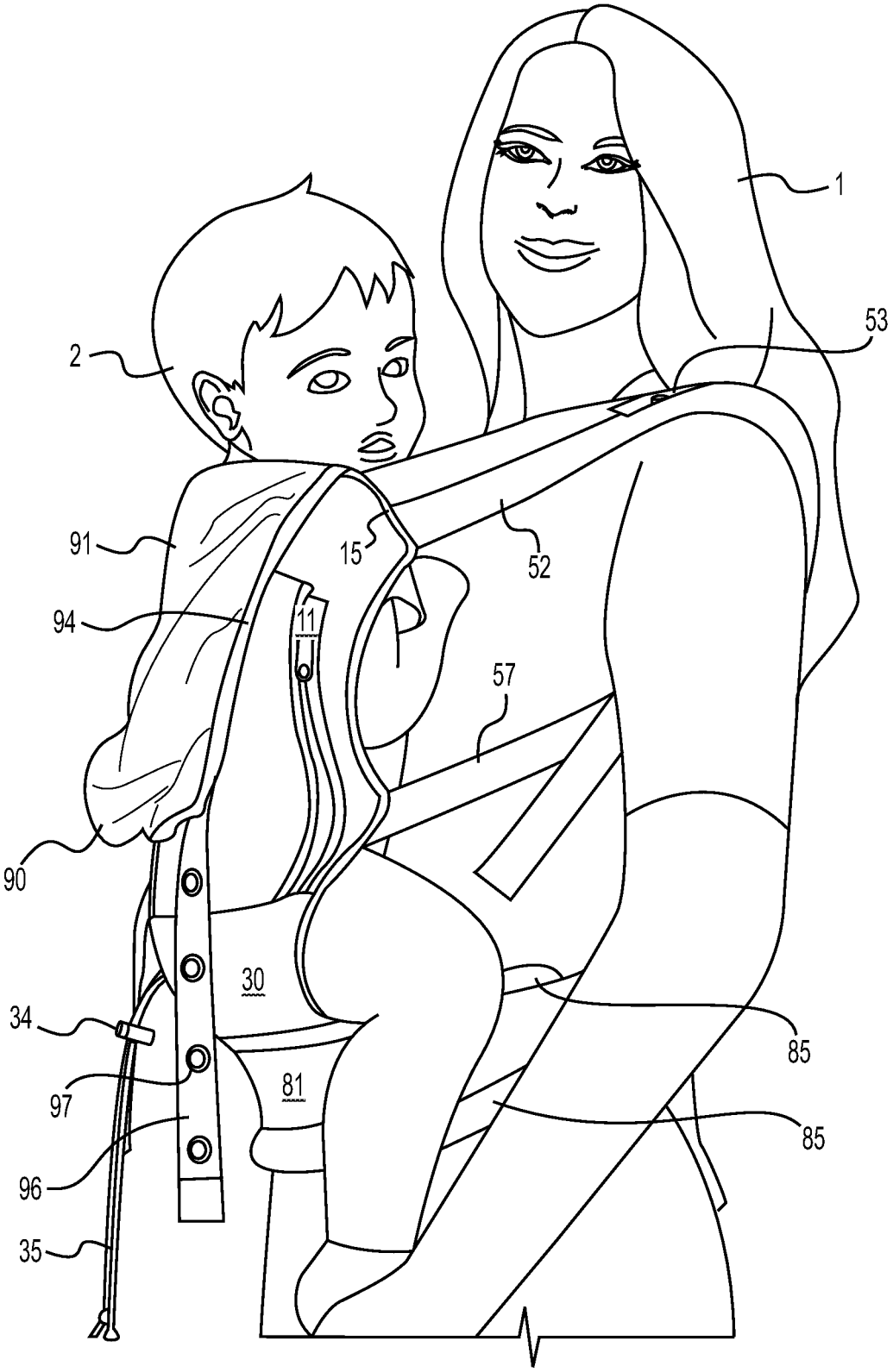
Figure 2F:
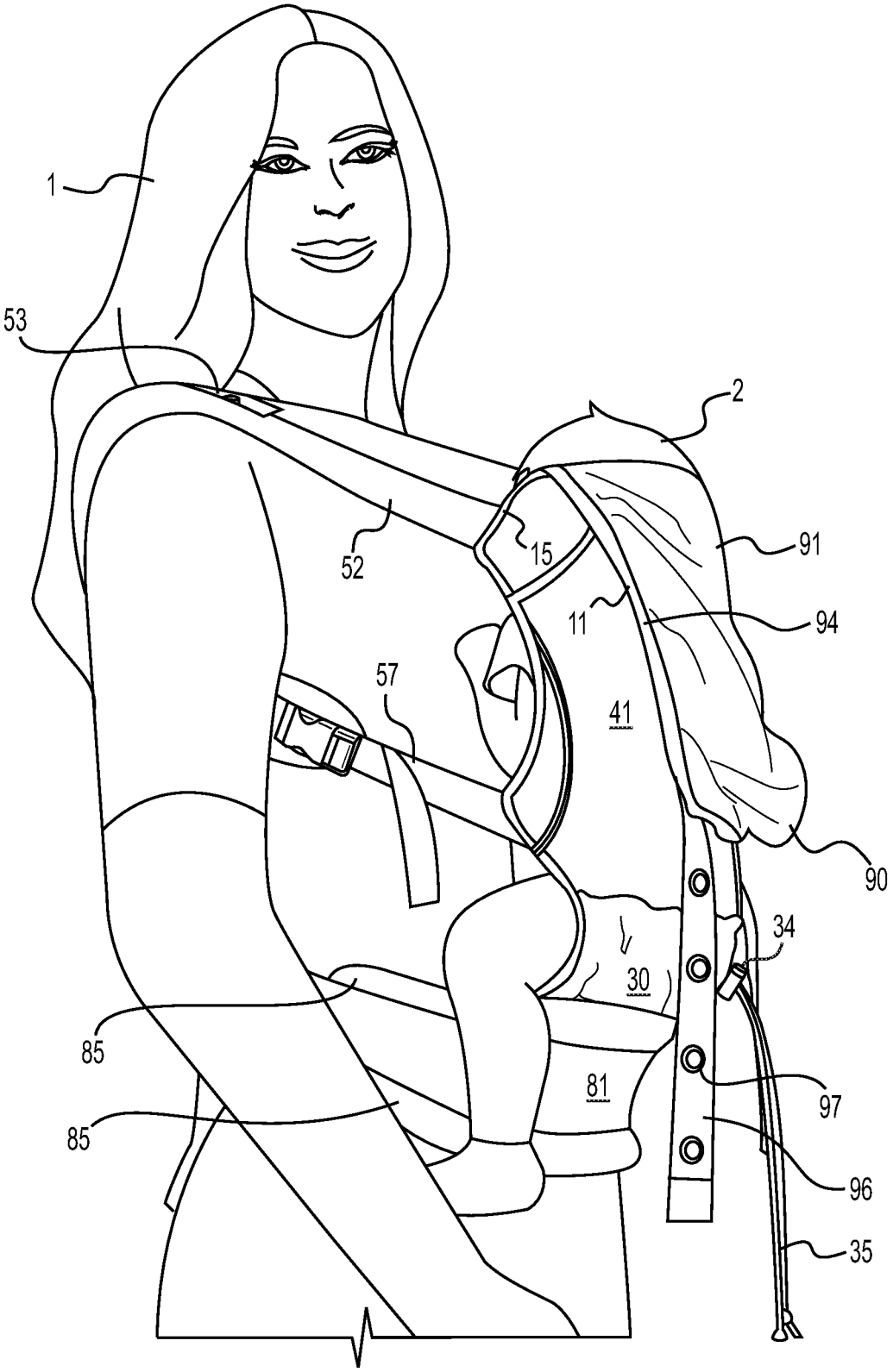

With reference to FIGS. 1C and 2E, to accommodate a larger baby 2, drawstring cinch 34 may only loosely engage the sides of drawstring 31. In such a configuration, draw string attachment points 35 are not pulled closer together and the area available for baby 2 to sit is at its maximum size.

As may be best observed in FIG. 1C, pockets 40 may include a more secure zipper pocket 41 and one or more stretch pockets 44, 46.

Zipper pocket 41 may include a zipper 43 and pocket layer 42. In preferred embodiments, pocket layer 42 may comprise the same material as base layer 21, such as 3 mm neoprene. One side of zipper 43 may be securely attached to pocket layer 42. Pocket layer 42 may be secured to base layer 21 on all sides except its zippered side. That is, base layer 21 may comprise the back side of zipper pocket 41. The other side of zipper 43 may be secured to base layer 21 with another piece of fabric or otherwise, such that zipping zipper 43 securely may securely hold the contents of zipper pocket 41. In preferred embodiments the portion of base layer 21 that comprises the back side of pocket 41 is integrally formed with other portions of base layer 21, but this disclosure is not so limited; in alternative embodiments, the portion of base layer 21 that comprises part of zipper pocket 41 may be a distinct piece of fabric from other portions of base layer 21 and/or may comprise a different material.

Stretch pocket 44 may comprise a stretch pocket layer 48 of Lycra, but may comprise any suitable material known in the art. In alternative embodiments, stretch pocket layer 48 may comprise a nylon-spandex mesh. The edges of stretch pocket layer 48 may be secured to base layer 21 or comprise hem 45/47. Hem 45/47 may enclose an elastic band and may be secured to base layer 21. Base layer 21 may comprise the back side of stretch pocket 44.

In certain embodiments, pockets 40 may also include secondary stretch pocket 46, which may be substantially hidden from view by stretch pocket 44. In certain embodiments, secondary stretch pocket 46 may comprise a fabric of nylon-spandex mesh, but the fabric may alternatively comprise another suitable material known in the art. The edges of secondary stretch pocket 46 may be secured to base layer 21 and/or comprise a hem 47. With reference to FIG. 1C, hem 47 may secure an edge portion of stretch pocket 44 to an edge portion of secondary stretch pocket 46.

As shown in FIG. 1C, a non-zippered edge of pocket layer 42 and a non-hemmed edge of stretch pocket layer 48 may abut along a central seam 19. Central seam 19 may secure the aforementioned abutted edges of pockets 41, 44 to base layer 21; it may approximately bisect a portion of front side 11 of main body 10. Additionally, central seam 19 may secure key loop 49 to base layer 21. As illustrated in, for example, FIGS. 1C and 3A, it is contemplated that, in various embodiments, the layout of pockets 40 may be reversible.

With reference to FIGS. 1A-1D, each shoulder strap 50 may comprise an upper shoulder strap portion 51 and a lower shoulder strap portion 56. Upper shoulder strap portion 51 may comprise upper strap 52, upper webbing 53, snap 55, and an upper portion of buckle 58. Upper strap 52 may be securely connected to angled attachment edge 15 of main body 10 at its top end. In preferred embodiments, upper strap 52 may comprise the same material as base layer 21, such as 3 mm neoprene. In certain embodiments, upper strap 52 may comprise two layers of material; optionally, padding may be included within the two layers of material. The top end of upper webbing 53 may be securely connected to upper strap 52. The secure connection between of upper webbing 53 and upper strap 52 may continue along a substantial portion of upper strap 52. Snap 55 may be attached to upper webbing 53 near the top end of upper webbing 53. The upper portion of buckle 58 may be attached to the bottom end of upper webbing 53.

Lower shoulder strap portion 56 may comprise lower webbing 57 and a lower portion of buckle 58. As may be best view in FIG. 1D, lower webbing 57 may be securely attached to main body 10 and/or hip belt 80 at lower webbing attachment point 54, which may preferably be along (or substantially adjacent to) bottom edge 14. A substantial portion of lower webbing 57 may be enclosed between base layer 21 and back layer 25 of back side 12. The lower portion of buckle 58 may be attached to the top end of lower webbing 57. In certain embodiments, upper webbing 53 and/or lower webbing 54 may comprise 1" nylon webbing; other suitable materials known in the art are also contemplated by this disclosure.

Shoulder strap 50 may further include adjustment mechanism 59 to enable user 1 to adjust shoulder strap 50 to an appropriate fit during use of baby carrier 100. In certain embodiments, as shown, adjustment mechanism 59 may be included in buckle 58. Buckle 58 may be a 1" buckle.

As may be best observed in FIGS. 1C and 1D, back strap 70 may include a first side 71, a second side 73, and a buckle 77. In the depicted embodiments, back strap 70 may loosely attach to shoulder straps 50 via loops 72, 74. One end of first side 71 may include first loop 72, which may encircle one shoulder strap 50; the other end of first side 71 may attach to a first side of buckle 77. One end of second side 73 may include second loop 74, which may encircle the other shoulder strap 90; the other end of second side 73 may attach to a second side of buckle 77. Although this disclosure is not limited to loop embodiments of back strap 70, it is noted that loops 72/74 may enable user 1 to easily position and reposition back strap 70 into a desired location in view of, for example, comfort, user 1's size, baby 2's size, whether baby carrier 100 is to be worn on the front or back of user 1, and/or the activity being undertaken.

In preferred embodiments, first side 71 and/or second side 72 may comprise the same material as upper webbing 53 and/or lower webbing 57, such as nylon webbing. Back strap 70 may further include adjustment mechanism 78 to enable user 1 to adjust back strap 70 to an appropriate fit during use of baby carrier 100. In certain embodiments, adjustment mechanism 78 may be included in buckle 77. Buckle 77 may be a 1" buckle.

With reference to FIGS. 1B and 1D, hip belt 80 may include thick strap 81, buckle 83, outer layer 85, and inner layer 86. Hip belt 80 may be securely attached to base layer 21 along bottom edge 14 of main body 10. In preferred embodiments, inner layer 85 and outer layer 86 may comprise the same material as base layer 21, such as 3 mm neoprene. In certain embodiments, inner layer 85 and outer layer 86 may be comprised of the same integral piece of fabric that is secured to base layer 21. In other embodiments, inner layer 85 and/or outer layer 86 may be comprised of the same integral piece of fabric as base layer 21. Optionally, padding may be included between outer layer 85 and inner layer 86.

A middle portion of thick strap 81 may be securely attached to outer layer 85. The secure connection between thick strap 81 and outer layer 85 may continue along the entirety or the majority of outer layer 85. Each end of thick strap 81 may attached to a portion of buckle 83. In certain embodiments, thick strap 81 may comprise 2" nylon webbing; other suitable materials known in the art are also contemplated by this disclosure. Hip belt 80 may further include adjustment mechanism 84 to enable user 1 to adjust it to an appropriate fit during use of baby carrier 100. In certain embodiments, adjustment mechanism 84 may be included in buckle 83. Buckle 83 may be a 2" buckle.

With reference to FIGS. 1C and 1D, hood 90 may include inner layer 91, outer layer 92, hem 94, and hood straps 96. Inner layer 91 and outer layer 92 may form the bulk of hood 90. In preferred embodiments, inner layer 91 and outer layer 92 may comprise the same material as back layer 25, such as a nylon-spandex mesh with anti-microbial properties. In certain embodiments, inner layer 91 and outer layer 92 may be comprised of the same integral piece of fabric that is secured the top edge 13 of body 10. Inner layer 91 and/or outer layer 92 may additionally or alternatively be comprised of the same integral piece of fabric as back layer 25.

Top edge 13 of body 10 may be one boundary of hood 90. Rounded hem 94 rounded may serve as the top edge of hood 90; it may be considered another boundary of the main form of hood 90. Hem 90 may enclose an elastic band. Hoods straps 96 may extend from (or through) hem 90. Each hood strap 96 may comprise one or a plurality of snaps 97 configured to engage with snap 55 of a shoulder strap 50. The snap sets 97/55 may be comprised of plastic or metal or other materials known in the art.

Ultimately, hood 90 may be utilized at user 1's discretion to shield baby 2 from the sun or other elements. Its preferred composition of a thin breathable fabric may serve to avoid overheating of baby 2 and promote quick-drying and rot-avoidance after wet uses.

Although the foregoing embodiments have been described in detail by way of illustration and example for purposes of clarity of understanding, it will be readily apparent to those of ordinary skill in the art in light of the description herein that certain changes and modifications may be made thereto without departing from the spirit or scope of the appended claims. It is also to be understood that the terminology used herein is for the purpose of describing particular aspects only, and is not intended to be limiting, since the scope of the present invention will be limited only by the appended claims.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation. As will be apparent to those of ordinary skill in the art upon reading this disclosure, each of the individual aspects described and illustrated herein has discrete components and features which may be readily separated from or combined with the features of any of the other several aspects without departing from the scope or spirit of the disclosure. Any recited method can be carried out in the order of events recited or in any other order that is logically possible. Accordingly, the preceding merely provides illustrative examples. It will be appreciated that those of ordinary skill in the art will be able to devise various arrangements which, although not explicitly described or shown herein, embody the principles of the disclosure and are included within its spirit and scope.

Furthermore, all examples and conditional language recited herein are principally intended to aid the reader in understanding the principles of the invention and the concepts contributed by the inventors to furthering the art, and are to be construed without limitation to such specifically recited examples and conditions. Moreover, all statements herein reciting principles and aspects of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary configurations shown and described herein.

In this specification, various preferred embodiments have been described with reference to the accompanying drawings. It will be apparent, however, that various other modifications and changes may be made thereto and additional embodiments may be implemented without departing from the broader scope of the claims that follow. The specification and drawings are accordingly to be regarded in an illustrative rather than restrictive sense.

I claim:

1. A carrier for holding a baby against the body of a user, comprising:

a main body, the main body having a front side, a back side, a first side edge, a second side edge, a bottom edge, and a top edge;

a base layer of the main body, the base layer being disposed on the front side of the main body;

a back layer of the main body, the back layer being disposed on the back side of the main body;

a child adjustment mechanism of the main body, the child adjustment mechanism configured to vary and stabilize a carrier seat length;

a hood, the hood being attached to the top edge of the main body;

at least one shoulder strap; and a hip belt, the hip belt being attached to the bottom edge of the main body;

wherein:

the base layer comprises neoprene;

the back layer comprises a quick-drying, flexible fabric that is not neoprene;

the main body further comprises at least one pocket disposed on the front side of the main body;

a portion of the base layer comprises a back side of the at least one pocket;

the at least one pocket comprises a zipper pocket and a first stretch pocket;

the zipper pocket comprises a zipper and a pocket layer;

the first stretch pocket comprises a stretch pocket layer and a first pocket hem;

a first non-zippered edge of the pocket layer and a first non-hemmed edge of the stretch pocket layer abut along a central seam of the front of the main body;

a second non-zippered edge of the pocket layer abuts a top of the child adjustment mechanism; and a second non-hemmed edge of the first stretch pocket layer abuts the top of the child adjustment mechanism; and the carrier is waterproof.

2. The carrier of claim 1, wherein the hood comprises the quick-drying, flexible fabric.

3. The carrier of claim 1, wherein the hood comprises:

an inner hood layer;

an outer hood layer;

a hem, the hem containing an elastic band; and at least one hood strap, the at least one hood strap configured to secure the hood over the head of the baby when connected to the at least one shoulder strap, wherein the inner hood layer and the outer hood layer substantially consist of the quick-drying, flexible fabric, and the quick-drying, flexible fabric comprises Nylon and Spandex.

4. The carrier of claim 3, wherein:

at least one of the inner hood layer and outer hood layer is integrally formed with the back layer.

5. The carrier of claim 1, wherein:

the quick-drying, flexible fabric is a nylon-spandex mesh with anti-microbial properties.

6. The carrier of claim 1, wherein:

the quick-drying, flexible fabric consists of 85%-95% Nylon and 5-15% Spandex.

7. The carrier of claim 1, wherein:

the base layer is 3 mm neoprene.

8. The carrier of claim 1, wherein:

the pocket layer is secured to the base layer; and a first side of the zipper is secured to the base layer;

a second side of the zipper is secured to the pocket layer; and the pocket layer comprises neoprene.

9. The carrier of claim 1, wherein:

the stretch pocket layer is secured to the base layer;

the first pocket hem contains an elastic band;

edges of the hem are secured to the base layer; and the stretch pocket layer comprises Lycra.

10. The carrier of claim 9, wherein:

the at least one pocket further comprises a secondary stretch pocket;

the secondary stretch pocket is disposed between the stretch pocket layer and the base layer;

the secondary stretch pocket comprises a secondary stretch pocket fabric and a second pocket hem;

the second pocket hem is secured to the base layer and the stretch pocket layer;

the second pocket hem contains a second elastic band; and the secondary stretch pocket fabric comprises Lycra or a Nylon-spandex mesh.

11. The carrier of claim 1, wherein:

the pocket layer is secured to the base layer;

a first side of the zipper is secured to the base layer;

a second side of the zipper is secured to the pocket layer; and the first stretch pocket layer is secured to the base layer.

12. A carrier for holding a baby against the body of a user, comprising:

a main body, the main body having a front side, a back side, a first side edge, a second side edge, a bottom edge, and a top edge;

a base layer of the main body, the base layer being disposed on the front side of the main body;

a back layer of the main body, the back layer being disposed on the back side of the main body;

a child adjustment mechanism of the main body, the child adjustment mechanism configured to vary and stabilize a carrier seat length; and at least one shoulder strap, wherein:

the main body further comprises at least one pocket disposed on the front side of the main body;

a portion of the base layer comprises a back side of the at least one pocket;

the at least one pocket comprises a zipper pocket and a first stretch pocket;

the zipper pocket comprises a zipper and a pocket layer;

the first stretch pocket comprises a stretch pocket layer and a first pocket hem;

a first non-zippered edge of the pocket layer and a first non-hemmed edge of the first stretch pocket layer abut along a central seam of the front of the main body;

a second non-zippered edge of the pocket layer abuts a top of the child adjustment mechanism; and a second non-hemmed edge of the first stretch pocket layer abuts the top of the child adjustment mechanism.

13. The carrier of claim 12, wherein:

the child adjustment mechanism abuts the hip belt;

the child adjustment mechanism comprises a drawstring, an enclosure layer, a cinch mechanism, and a portion of the base layer;

the drawstring comprises a first drawstring side and a second drawstring side;

the enclosure layer and the portion of the base layer are securely attached on all edges of the enclosure layer to form an enclosure;

the first drawstring side and the second drawstring side are partially enclosed within the enclosure;

the enclosure layer includes a first drawstring hole and a second drawstring hole;

an end of the first drawstring side is secured to a first point on the base layer;

the first drawstring side extends through the first drawstring hole;

an end of the second drawstring side is secured to a second point on the base layer;

the second drawstring side extends through the second drawstring hole;

the cinch mechanism is configured to vary and stabilize the carrier seat length by securing an external portion of the first drawstring side to an external portion of the second drawstring side.

14. The carrier of claim 13, wherein:

the first point on the base layer is along the first side edge of the main body;

the second point on the base layer is along the second side edge of the main body; and the enclosure layer comprises neoprene.

15. The carrier of claim 13, wherein:

the child adjustment mechanism is configured to vary and stabilize the carrier seat length to accommodate the baby when the baby is at least as small as 10 lb.; and the child adjustment mechanism is configured to vary and stabilize the carrier seat length to accommodate the baby when the baby is at least as large as 40 lb.

16. The carrier of claim 12, wherein:

the main body further comprises:

a first angled attachment edge disposed between the top edge of the main body and the first side edge of the main body; and a second angled attachment edge disposed between the top edge of the main body and the second side edge of the main body;

the at least one shoulder strap includes a first shoulder strap and a second should strap;

the first shoulder strap is securely attached to the first angled attachment edge of the main body and at the bottom edge of the main body; and the second shoulder strap is securely attached to the second angled attachment edge of the main body and at the bottom edge of the main body.

17. The carrier of claim 12, wherein:

a lower portion of the at least one shoulder strap comprises nylon webbing;

a substantial portion of the lower portion of the at least one shoulder strap is enclosed between the base layer and the back layer; and an upper portion of the at least one shoulder strap comprises neoprene.

18. The carrier of claim 17, wherein:

the hip belt comprises an inner belt layer, an outer belt layer, and a hip strap;

the inner belt layer and the outer belt layer substantially consist of neoprene;

the hip strap is secured to the outer belt layer and comprises nylon webbing; and the lower portion of the at least one shoulder strap is secured to the inner belt layer and the outer belt layer.

19. The carrier of claim 12, wherein:

the front of the main body further comprises a key loop, the key loop being secured to the base layer by the central seam.

20. The carrier of claim 12, wherein:

a first side of the zipper is secured to the base layer; and a second side of the zipper is secured to the pocket layer.

* * * * *